United States Patent [19]

Rizzardi

[11] Patent Number: 4,568,349

[45] Date of Patent: Feb. 4, 1986

[54] ALKALI TREATMENT OF CELLULOSIC FIBER GOODS

[75] Inventor: Angelo Rizzardi, Halle, Fed. Rep. of Germany

[73] Assignee: Sandoz Ltd., Basel, Switzerland

[21] Appl. No.: 408,189

[22] Filed: Aug. 16, 1982

[30] Foreign Application Priority Data

Aug. 22, 1981 [DE] Fed. Rep. of Germany ..... 3133300
Jun. 12, 1982 [DE] Fed. Rep. of Germany ..... 3222167

[51] Int. Cl.[4] ..... D06M 1/02
[52] U.S. Cl. ..... 8/125; 8/137
[58] Field of Search ..... 8/125

[56] References Cited

U.S. PATENT DOCUMENTS

| | | | |
|---|---|---|---|
| 600,827 | 3/1898 | Thomas et al. | 8/125 |
| 2,179,505 | 11/1939 | Huey | 8/125 |
| 3,297,399 | 1/1967 | Hobbs | 8/125 |
| 3,476,501 | 11/1969 | Lorenz et al. | 8/125 |
| 3,890,093 | 6/1975 | Diery et al. | 8/125 |
| 3,960,484 | 6/1976 | Leimbacher et al. | 8/125 |

FOREIGN PATENT DOCUMENTS

| | | | |
|---|---|---|---|
| 57257 | 8/1982 | European Pat. Off. . | |
| 98601 | 7/1898 | Fed. Rep. of Germany . | |
| 2941633 | 4/1981 | Fed. Rep. of Germany . | |
| 490567 | 8/1938 | United Kingdom . | |
| 715376 | 9/1954 | United Kingdom | 8/125 |
| 831220 | 3/1960 | United Kingdom . | |
| 1211116 | 11/1970 | United Kingdom . | |
| 1485756 | 9/1977 | United Kingdom . | |

OTHER PUBLICATIONS

Hall, A. J. *The Standard Handbook of Textiles,* John Wiley & Sons, N.Y., 1975 p. 228.

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

The invention relates to a process for alkali-dry treating cellulosic fibre goods comprising the steps of (a) treating the goods with an aqueous caustic soda solution of 18°-26° Baumé, followed by (b) drying the treated goods under tension without an intermediate rinsing or neutralization step.

The aqueous caustic soda solution used in step (a) may further contain a lubricant and wetting agents.

30 Claims, No Drawings

ALKALI TREATMENT OF CELLULOSIC FIBER GOODS

The present invention relates to an alkali-dry treatment for natural cellulose fibres or blends thereof with regenerated cellulose and/or synthetic fibres.

The finishing of cotton by treating with caustic alkali is a well known process which removes impurities, stabilizes the fabric, improves the receptivity to dyestuffs and increases gloss. In many cases the alkali treatment also improves the appearance and the tear strength of the goods.

It is known to carry out the alkali treatment of cotton goods with an intermediate drying step between the steps of treatment with the alkali solution and final rinsing and drying. However, when the conventional strength of caustic soda is used, i.e. from 28°-33° Baumé, an alkali process with intermediate drying may cause damage to the fibres.

Surprisingly it has now been found that good results (particularly for knitted cotton goods) are obtained in an alkali-dry process with intermediate drying by operating at an alkali strength of only 18°-26° Baumé, a strength at which it was previously believed that no significant improvement in properties could be obtained.

Accordingly, the present invention provides a process for the alkali-dry treatment of cellulosic fibre goods comprising the steps of (a) treating the goods with an aqueous caustic soda solution of 18°-26° Baumé, followed by (b) drying the treated goods under tension without an intermediate rinsing or neutralization step.

The aqueous caustic soda solution used in step (a) has preferably an alkali strength of 18°-23° Baumé. In addition to the sodium hydroxide, the solution may contain further alkali-resistant additives, e.g. wetting agents, surfactants, detergents and lubricants depending on the material to be treated and the desired additional effect, e.g. a fast wetting of the goods, or an easy removal of chemicals and impurities during a later washing step. The presence of a lubricant in the alkali treatment solution used in step (a) is particularly advantageous as such an agent facilitates an even distribution of the tension force over the surface of the goods by reducing the friction of the fibres against one another.

Preferred wetting agents are anionic, non-ionic or amphoteric surfactants. Such compounds are known and commercially available. More preferably the wetting agent is of the anionic type, optionally in the form of a mixture with a non-ionic or amphoteric wetting agent. Suitable anionic wetting agents include:

(i) sulphated or non-sulphated $C_{4-24}$ alcohols or glycols, optionally ethoxylated with 1 to 25 ethyleneoxy units;

(ii) alkyl $C_{8-20}$ phosphoric acid esters or semi-esters;

(iii) alkyl $C_{1-20}$ poly (1-25) glycol ether phosphoric acid esters;

(iv) arylsulphonates, e.g. cumenesulphonates;

(v) sulphated fatty acids, e.g. sulphated aliphatic saturated or unsaturated fatty acids, preferably $C_{16-18}$ fatty acids, (vi) sulphated fatty acid esters, mono- or diamides;

(vii) sulphonated fatty acid mono- or diamides, and (viii) carboxymethylated addition products of 1 to 25 moles of ethylene oxide to a $C_{4-24}$ alcohol.

Preferred anionic wetting agents are those of the type (i), (iii), (iv) and (vii), optionally in form of a mixture of two or more of these.

The anionic wetting agents may be used in admixture with non-ionic wetting agents such as those obtained by addition of ethylene oxide, preferably from 1 to 25 moles of ethylene oxide, to a higher alkyl-substituted phenol, preferably a $C_{4-14}$ alkylphenol.

Particularly preferred wetting agents are those having, in addition to their wetting properties, a detergent effect enabling the removal of chemicals, especially sodium silicate, during a later rinsing or washing step.

The proportion of caustic soda to total wetting agent in the treatment liquor is suitably from 50:1 to 10:1 based on dry weight, preferably from 40:1 to 20:1, more preferably from 35:1 to 25:1.

Suitably the treatment liquor used in step (a) contains an alkali-resistant textile lubricant. Such compounds are commercially available. Some lubricants may also have a wetting effect in addition to their lubricating properties. When such lubricants are used, both the desired wetting and lubricating effect may be performed by the same compound. However, as the wetting power of such lubricants may not be sufficient, it is preferred to add a further wetting agent to the caustic treatment liquor.

Preferred lubricants are polyalkylene emulsified in water, e.g. oxidized polyethylene waxes having a molecular weight of e.g. 1,000 to 10,000, or sulphonated or sulphated castor oil.

Preferably the alkali treatment liquor contains at least one wetting agent and a lubricant. According to a preferred embodiment of the invention, the treatment liquor used in step (a) contains a mixture of anionic wetting agents, optionally together with one or more non-ionic wetting agents, and a lubricant. The amount of lubricant in the treatment liquor may be from 5 to 60% by weight of the total wetting agent (based on dry weight).

The treatment liquor may also contain sodium silicate (waterglass), the proportion by weight of sodium silicate to sodium hydroxide (based on dry weight) being from 1:12 to 1:3, preferably from 1:6 to 1:4. The sodium silicate is preferably added in the form of commercial waterglass, which is a 35-40% aqueous solution. When sodium silicate is present in addition to sodium hydroxide, the concentration of 18°-26° Bé refers to the total concentration of both ingredients, not to that of the sodium hydroxide alone.

The aqueous alkali treatment liquor used in step (a) and comprising, in addition to the sodium hydroxide, at least one wetting agent, an alkali-resistant lubricant and optionally sodium silicate also forms part of the invention.

The additives may be added to the alkali treatment liquor either separately or together in form of an aqueous composition. Sodium silicate is preferably added separately. The concentration of the other additives in the composition, e.g. wetting agents and lubricants, may be up to 70% by weight.

The composition is preferably adjusted at pH 7 to 9, e.g. by neutralization with ammonia. Before use, optionally after addition of the sodium silicate, the composition may be diluted to the desired concentration, e.g. by adding to the caustic soda solution. The caustic soda solution may be adjusted to the desired concentration from 18° to 26° Bé either before or after the addition of the composition.

The alkali treatment step (a) comprises the impregnation of the cellulosic goods, preferably knitted goods, with the alkali liquor and, after a short dwelling, a tension treatment on a tenter frame machine. The impregnation is carried out at room temperature, preferably from 20° to 30° C., according to a conventional pad-dry process. The goods are treated open-width, preferably under such conditions that they are completely and regularly wetted in a short time. The pick-up is preferably from 90 to 120%.

Immediately after impregnation the goods are dwelled and then stretched on a conventional tenter frame machine, e.g. an air cushion tenter frame, to the optimal geometrical dimensions (stitch course and wale). These dimensions are adjusted as a function of the finished width and the weight per square meter. Shrinkage of the cellulosic material takes place during the impregnation and the subsequent dwelling. The reaction time (shrinkage and stretching) may vary from 40 to 60 seconds. Preferably the goods are stretched for 1/6 to ⅓ of the reaction time before drying.

The drying step (b) is carried out directly thereafter on the tension frame i.e. without any intermediate rinsing or neutralization step. Preferred drying temperatures are in the range 100°–140° C., more preferably 130°–140° C. and suitable drying times are from 30 seconds to 1 minute. Preferably the goods are dried with dry air to a residual moisture of about 3 to 5%.

After drying, the goods may be rinsed, either immediately or at a later time. It is an advantage of the process of the invention that the dried goods may be stored for some time without deterioration. Rinsing may be carried out at any temperature from room temperature to the boil, temperatures at the higher end of this range being recommended when silicate is present. Optionally a conventional surfactant may be used in the rinsing step, and the rinse water is advantageously softened or demineralized water. In order to achieve good wash-shrinkage values, rinsing is preferably carried out under tension-free conditions. The goods, which appear yellow after the drying step, are pure white after rinsing.

Preferably, the cellulosic fibre goods treated according to the invention are cotton goods.

The alkali-dry process according to the invention gives a smooth appearance to the goods and an increased gloss, properties which are of particular importance for cotton knitted goods. The goods also have better tear strength, wash-shrinkage values, elongation strength and stability and give deeper dyeings than those treated by a conventional alkali process. The alkali-dry process of the invention causes no fall of the average polymerisation degree of cellulose or only an unsignificant fall. The treated cotton goods, particularly knitted goods such as Interlock or Jersey, show particularly good effects when dyed and finished.

The following Examples In which all parts and percentages are by weight and all temperatures are in degrees Centigrade, illustrate the invention.

EXAMPLE 1

A bleached cotton tricot (interlock knit) is padded at 90% pick-up with a 20° Bé solution containing, per liter of demineralised water:

170 parts sodium hydroxide (dry weight)

5 parts commercially obtainable wetting agent consisting of 5 to 10% of a nonylphenol ethoxylated with an average of 10 moles ethylene oxide and 30 to 40% of the phosphate ester of a $C_{10-20}$ fatty alcohol ethoxylated with an average of 10 moles ethylene oxide, as the ammonium salt (dry weight)

5 parts of an alkali-resistant polyethylene emulsion in water (25%)

and 20 parts sodium silicate (dry weight) added as waterglass of 38°–40° Bé and then stretched for 15 seconds on an air-cushion tenter frame. The treated goods are then continuously passed on the tenter frame through a series of drying ovens at 110° (drying time 60 seconds, residual moisture ~ 3–5%), the dimensions of the goods being controlled.

After rinsing with softened water the goods are again dried on the tenter frame at approx. 130° C., (with advance) to give a pure white glossy fabric.

The same good results are obtained when 220 parts NaOH(26° Bé) instead of 170 parts are used in the alkali-dry process described above.

EXAMPLE 2

A cotton tricot (interlock or single jersey knit, non bleached) is padded at 90% pick-up with a 22° Bé solution containing, per liter of demineralised water:

185 parts sodium hydroxide (dry weight) 5 parts of the wetting agent of Example 1 5 parts of the polyethylene emulsion of Example 1 20 parts sodium silicate as described in Example 1 and 10 parts semi-sulphate of a mixture of branched chain $C_{6-12}$ alcohols.

The treated goods are stretched and dried on a tenter frame at 120° as described in Example 1.

After rinsing with softened water containing a commercially available sequestrant, the goods are acidified with acetic acid in open-width state and tension-free at 80° and then again rinsed. Subsequently, the goods are again dried on the tenter frame at 140° C.

By following the samd procedure but using 240 parts sodium hydroxide (26° Bé) instead of 185 parts, the same good effect is obtained.

EXAMPLE 3

A polyester/cotton tricot (interlock knit, non bleached) is padded at 90% pick-up with a 20° Bé solution containing, per liter of demineralised water:

170 parts sodium hydroxide (dry weight)

5 parts of the modified phosphate ester of Example 1

10 parts of the semi-sulphate of branched chain $C_{6-12}$ alcohols of Example 2

20 parts sodium silicate (dry weight) added as waterglass of 38°–40° Bé and 2 parts of polyethylene emulsion of Example 1.

The goods are then further treated according to Example 2 and a good effect is obtained.

EXAMPLE 10

By following the procedure of Example 1 but using a treatment liquor containing, per liter of demineralised water:

190 parts sodium hydroxide (dry weight)

6 parts sulphated $C_8$-alcohol 2 parts of an anionic modified fatty acid amide (reaction product of stearic acid, N-hydroxyethyl-ethylene diamine, epichlorhydrine and bisulphite)

3 parts dodecylbenzene sulphonic acid 6 parts sulphated castor oil 20 parts sodium silicate (dry weight) added as waterglass of 38°–40° Bé a good effect is achieved.

What is claimed is:

1. A process for the alkali-dry treatment of knitted cellulosic fiber goods which comprises the steps of (a) impregnating the goods with an aqueous caustic soda solution of 18°–26° Baumé containing sodium silicate and an alkali resistant anionic wetting agent, and (b) drying the treated goods under tension, without an intermediate rinsing or neutralization step 2. A process according to claim 1, wherein the aqueous caustic soda solution used in step (a) has an alkali strength of 18° to 23° Baumé.

3. A process according to claim 1, wherein the anionic wetting agent is selected from (i) sulphated and non-sulphated $C_{4-24}$ alcohols or glycols, optionally ethoxylated with 1 to 25 ethyleneoxy units;

(ii) alkyl $C_{8-20}$ phosphoric acid esters and semi-esters;

(iii) alkyl $C_{1-20}$ poly (1–25) glycol ether phosphoric acid esters;

(iv) arylsulphonates;

(v) sulphated fatty acids;

(vi) sulphated fatty acid esters and mono- and diamides;

(vii) sulphonated fatty acid mono- and diamides; and (viii) carboxymethylated addition product of 1 to 25 moles of ethylene oxide to a $C_{4-24}$ alcohol.

4. A process according to claim 3 wherein the proportion of caustic soda to total wetting agent is from 50:1 to 10:1, based on dry weight.

5. A process according to claim 4 wherein the anionic wetting agent is selected from the group consisting of (i), (iii), (iv) and (vii).

6. A process according to claim 4 which comprises the further step, following step (b), of rinsing the dried goods under tension-free conditions.

7. A process according to claim 6, wherein the proportion by weight of sodium silicate to sodium hydroxide is from 1:12 to 1:3 based on dry weight.

8. A process according to claim 3 wherein the aqueous caustic soda solution contains an amount of wetting agent sufficient to effect fast wetting of the cellulosic fiber goods and wherein, following the impregnation step (a), the goods are dwelled and then stretched and then dried according to step (b), with shrinkage taking place during the impregnation and dwelling, and the total time during which shrinking, stretching and drying is effected is 70 to 120 minutes.

9. A process according to claim 8 wherein the anionic wetting agent is selected from the group consisting of (i), (iii), (iv) and (vii).

10. A process according to claim 3 wherein the anionic wetting agent is selected from the group consisting of (i), (iii), (iv) and (vii).

11. A process according to claim 1 wherein the proportion of caustic soda to total wetting agent is from 50:1 to 10:1 based on dry weight.

12. A process according to claim 11, wherein the proportion by weight of sodium silicate to sodium hydroxide is from 1:12 to 1:3 based on dry weight.

13. A process according to claim 1, wherein the proportion by weight of sodium silicate to sodium hydroxide is from 1:12 to 1:3 based on dry weight.

14. A process according to claim 1, wherein in step (a) the cellulose goods are impregnated open-width at room temperature.

15. A process according to claim 14, wherein after impregnation the cellulosic goods are dwelled and then stretched.

16. A process according to claim 1, wherein the cellulosic goods are dried in step (b) at a temperature from 100° to 140° C.

17. A process according to claim 1 wherein the aqueous caustic soda solution further contains a non-ionic wetting agent.

18. A process according to claim 17, wherein the non-ionic wetting agent is an addition product of 1 to 25 moles ethylene oxide to a $C_{4-14}$ alkyl-phenol.

19. A process according to claim 1 wherein step (b) is effected in a time of 30 to 60 seconds.

20. A process according to claim 1 wherein the aqueous caustic soda solution contains an amount of wetting agent sufficient to effect fast wetting of the cellulosic fiber goods and wherein, following the impregnation step (a), the goods are dwelled and then stretched and then dried according to step (b), with shrinkage taking place during the impregnation and dwelling, and the total time during which shrinking, stretching and drying is effected is 70 to 120 minutes.

21. A process according to claim 1 wherein the aqueous caustic soda solution further contains an alkali-resistant textile lubricant.

22. A process according to claim 21, wherein the amount of lubricant is from 5 to 60% by weight of the total wetting agent, based on dry weight.

23. A process according to claim 21 wherein the alkali-resistant textile lubricant is oxidized polyethylene wax, sulphonated castor oil or sulphated castor oil.

24. A process according to claim 23 wherein the proportion of caustic soda to total wetting agent is from 50:1 to 10:1, based on dry weight, and the amount of lubricant is from 5 to 60% by weight of the total wetting agent, based on dry weight.

25. A process according to claim 24 wherein the anionic wetting agent is selected from (i) sulphated and non-sulphated $C_{4-24}$ alcohols or glycols, optionally ethoxylated with 1 to 25 ethyleneoxy units;

(ii) alkyl $C_{8-20}$ phosphoric acid esters and semi-esters;

(iii) alkyl $C_{1-20}$ poly (1–25) glycol ether phosphoric acid esters;

(iv) arylsulphonates;

(v) sulphated fatty acids;

(vi) sulphated fatty acid esters and mono- and diamides;

(vii) sulphonated fatty acid mono- and diamides; and (viii) carboxymethylated addition product of 1 to 25 moles of ethylene oxide to a $C_{4-24}$ alcohol.

26. A process according to claim 24 wherein the aqueous caustic soda solution contains an amount of wetting agent sufficient to effect fast wetting of the cellulosic fiber goods and wherein, following the impregnation step (a), the goods are dwelled and then stretched and then dried according to step (b), with shrinkage taking place during the impregnation and dwelling, and the total time during which shrinking, stretching and drying is effected is 70 to 120 minutes.

27. A process according to claim 23 wherein the alkali-resistant textile lubricant is oxidized polyethylene wax.

28. A process according to claim 25 wherein the anionic wetting agent is selected from the group consisting of (i), (iii), (iv) and (vii).

29. A process according to claim 27 which comprises the further step, following step (b), of rinsing the dried goods under tension-free conditions.

30. A process according to claim 1 which comprises the further step, following step (b), of rinsing the dried goods under tension-free conditions.

* * * * *